US010737861B2

(12) United States Patent
Erickson

(10) Patent No.: US 10,737,861 B2
(45) Date of Patent: Aug. 11, 2020

(54) SPOUT FOR A FLEXIBLE BAG AND FLEXIBLE BAG HAVING A SPOUT

(71) Applicant: Scholle IPN Corporation, Northlake, IL (US)

(72) Inventor: Kyle Erickson, Chicago, IL (US)

(73) Assignee: Scholle IPN Corporation, Northlake, IL (US)

( * ) Notice: Subject to any disclaimer, the term of this patent is extended or adjusted under 35 U.S.C. 154(b) by 0 days.

(21) Appl. No.: 15/691,343

(22) Filed: Aug. 30, 2017

(65) Prior Publication Data

US 2018/0057236 A1 Mar. 1, 2018

Related U.S. Application Data

(60) Provisional application No. 62/381,205, filed on Aug. 30, 2016.

(51) Int. Cl.

| | |
|---|---|
| ***B65D 75/58*** | (2006.01) |
| ***B65D 30/24*** | (2006.01) |
| ***B65D 33/02*** | (2006.01) |

(52) U.S. Cl.

CPC ..... *B65D 75/5866* (2013.01); *B65D 31/147* (2013.01); *B65D 33/02* (2013.01); *B65D 75/5877* (2013.01)

(58) Field of Classification Search

CPC .. B65D 75/5866; B65D 31/147; B65D 33/02; B65D 75/5877; F16L 37/244; F16L 37/48; Y10T 137/87273; Y10T 137/87539

USPC ..... 251/149.6, 353, 339, 337; 137/801, 137/601.18

See application file for complete search history.

(56) References Cited

U.S. PATENT DOCUMENTS

| | | | | |
|---|---|---|---|---|
| 4,286,636 | A * | 9/1981 | Credle | B65D 83/0055 141/114 |
| 4,445,539 | A * | 5/1984 | Credle | B65D 83/0055 137/614.03 |
| 5,255,713 | A * | 10/1993 | Scholle | B67D 1/0835 137/535 |
| 5,445,186 | A * | 8/1995 | Richter | B65D 47/2075 137/614.03 |
| 5,477,883 | A * | 12/1995 | Totten | B65D 77/067 137/614.03 |
| 5,884,648 | A * | 3/1999 | Savage | B67D 7/0294 137/1 |
| 5,983,964 | A | 11/1999 | Zielinksi et al. | |
| 6,347,785 | B1 | 2/2002 | Copp et al. | |
| 6,612,545 | B1 | 9/2003 | Rutter et al. | |
| 7,487,951 | B2 * | 2/2009 | Johnson | B65D 77/067 251/149.1 |
| 2016/0009462 | A1 | 1/2016 | Erickson et al. | |

* cited by examiner

*Primary Examiner* — Craig J Price
*Assistant Examiner* — Andrew J Rost
(74) *Attorney, Agent, or Firm* — The Watson IP Group, PLC; Jovan N. Jovanovic

(57) ABSTRACT

A spout for use with a flexible bag and a flexible bag having a spout. The spout includes a threadform that extends about the outer surface. The threadform includes opposing threadforms that are of different configurations. Additionally, the insert member includes a poppet and a spring member to maintain the poppet in a configuration that precludes the passage of fluid therethrough.

16 Claims, 12 Drawing Sheets

SPOUT FOR A FLEXIBLE BAG AND FLEXIBLE BAG HAVING A SPOUT

CROSS-REFERENCE TO RELATED APPLICATION

This application claims priority from U.S. Pat. App. Ser. No. 62/381,205 filed Aug. 30, 2016, entitled "Spout For A Flexible Bag And Flexible Bag Having A Spout," the entire disclosure of which, including any applications incorporated by reference therein, is hereby incorporated by reference in its entirety.

BACKGROUND OF THE DISCLOSURE

1. Field of the Disclosure

The invention relates in general to flexible packaging, and more particularly, to a spout assembly for a flexible bag that is configured to interface with a plurality of different connectors commonly utilized in the dispensing of flowable material from such flexible bags.

2. Background Art

The use of flexible packaging is known in the art. Often the flexible packaging comprises a flexible bag having a spout assembly that is positioned within an outer rigid container (such as a box). The flexible bag includes a flowable material such as a liquid, a syrup, a juice, a gel or the like. The spout assembly is coupled to an adapter which is coupled to dispensing equipment. The flowable material is often withdrawn through the dispensing equipment by way of a vacuum or a pump or the like.

Any number of different types of adapters are known in the art. Problematically, it is desirable to utilize a single spout that is capable of coupling to a plurality of such adapters. In the case of threaded spouts, due to various issues such as vibration, creep and deformation, it is often the case that the connections can loosen over time and often while still in use.

SUMMARY OF THE DISCLOSURE

The disclosure is directed to a spout for use with a flexible bag and a flexible bag having a spout. The spout includes a threadform that extends about the outer surface. The threadform includes opposing threadforms that are of different configurations. Additionally, the insert member includes a poppet and a spring member to maintain the poppet in a configuration that precludes the passage of fluid therethrough.

In an aspect of the disclosure, the disclosure is directed to a fitment comprising a spout member, and an insert. The insert is positioned within the spout member and the insert defines a valve assembly. The valve assembly includes a first portion, a second portion and a spring member. The first portion is fixedly coupled to the insert member. The first portion has a base with an upper surface and a lower surface. A central bore extends therethrough and at least one openings extends therethrough. A lower circumferential depending skirt extends away from the lower surface of the base and encircles the at least one opening and the central bore. The lower circumferential depending skirt has an inner surface and terminates at a lower edge. A seal surface is positioned on the inner surface of the lower circumferential depending skirt.

In such a configuration, the second portion is slidably movable relative to the first portion. The second portion includes a body with a central post extending upwardly from the body and into the central bore. A depending outer rim extends about the body and includes a sealing surface disposed thereon. The second portion is slidably positionable between a sealing configuration wherein the seal surface of the first portion sealingly engages with the sealing surface of the second portion, to preclude the passage of fluid across the second portion and through the at least one opening of the first portion and an open configuration wherein the sealing surface is spaced apart from the seal surface.

In such a configuration, a spring member has a central body member, an outer circumferential ring member and a biasing member extending therebetween. The outer circumferential ring member is fixedly coupled to the insert member with the central body radially inwardly spaced therefrom. The central body has a top surface engageable with the second portion. The biasing member includes at least one opening. The biasing member biases the second portion into a sealing configuration. Overcoming the biasing member places the second portion into an open configuration.

In some configurations, the at least one opening is axially spaced apart from the central bore, with a raised encircling portion extending upwardly away from the upper surface of the base of the first portion about the central bore.

In some such configurations, the at least one opening comprises a plurality of openings axially spaced outwardly from the central bore and between the central bore and the lower circumferential depending skirt.

In some such configurations, the second portion includes a body has an upper surface. The upper surface of the body is spaced apart from the lower surface of the base of the first portion when the second portion is in the sealing configuration.

In some configurations, the sealing surface of the depending outer rim is spaced apart from the upper surface of the body.

In some configurations, the seal surface of the lower circumferential depending skirt is spaced apart from the lower edge thereof.

In some configurations, the second portion further includes an outer circumferential flange that is positioned at an end of the depending outer rim, opposite the body. The outer circumferential flange extends axially outwardly from the depending outer rim.

In some configurations, the outer circumferential flange extends axially outwardly beyond the lower circumferential depending skirt of the second portion.

In some configurations, the sealed configuration the outer circumferential flange remains spaced apart from the lower edge of the lower circumferential depending skirt.

In some configurations, the insert member is slidably movable relative to the spout member.

In some configurations, the outer circumferential ring member of the spring member includes an outer locking flange structurally configured to fixedly engage a recessed circumferential channel in the insert member.

In some configurations, the recessed circumferential channel in the insert member includes a plurality of axial openings extending therethrough to an outer surface of the insert member.

In some configurations, the outer circumferential ring member further includes a top edge and a bottom edge, with the biasing member coupled to the outer circumferential ring spaced apart from each of the top edge and the bottom edge.

In some configurations, the biasing member defines a hoop-like member that is concave in an upward direction toward the second portion.

In some configurations, the biasing member includes an annular inflection ring spaced apart from the inner end and the outer end thereof. An inner portion between the inner end and the annular inflection ring extends in a direction away from the second portion to the annular inflection ring. An outer portion between the outer end and the annular inflection ring extends in a direction toward the first portion and away from the annular inflection ring.

In some configurations, the outer portion of the biasing member further includes an annular stop member which is configured to interface with the outer circumferential ring member to preclude further relative movement therebetween in a first direction.

In some configurations, the first portion is integrally formed with the insert member, and wherein the second portion and the spring member comprise separate components.

In some configurations, the spout member further comprises a base flange, a body and a dual lead thread. The body extends from the base flange. The body has a proximal end and a distal end. The dual lead thread extends along the outer surface of the body between the proximal and distal ends thereof. The dual lead thread has a first threadform and a second threadform. The first threadform has a first threadform length and the second threadform having a second threadform length, with the length of the first threadform being different than that of the second threadform. The first threadform includes an upper portion and a lower portion and the second threadform includes an upper portion and a lower portion. Each upper portion and each lower portion have a length, wherein the length of the upper portion of the first threadform is different than the length of the upper portion of the second threadform. Similarly, the length of the lower portion of the first threadform is different than the length of the lower portion of the second threadform.

In the configuration described, the lower portion of the first threadform is spaced about 180° from the lower portion of the second threadform. The upper portion of the first threadform is spaced about 270° from the lower portion of the first threadform. The upper portion of the second threadform is spaced about 270° from the lower portion of the second threadform. The upper portion of the first threadform is spaced about 180° from the upper portion of the second threadform.

In some configurations, the first threadform and the second threadform terminate at an upper body flange that is spaced apart from the proximal and distal end of the body of the spout.

In some configurations, the lower portion of the first and second threadform each define a thickness, with the thickness being substantially uniform.

BRIEF DESCRIPTION OF THE DRAWINGS

The disclosure will now be described with reference to the drawings wherein.

DETAILED DESCRIPTION OF THE DISCLOSURE

Figure 1:
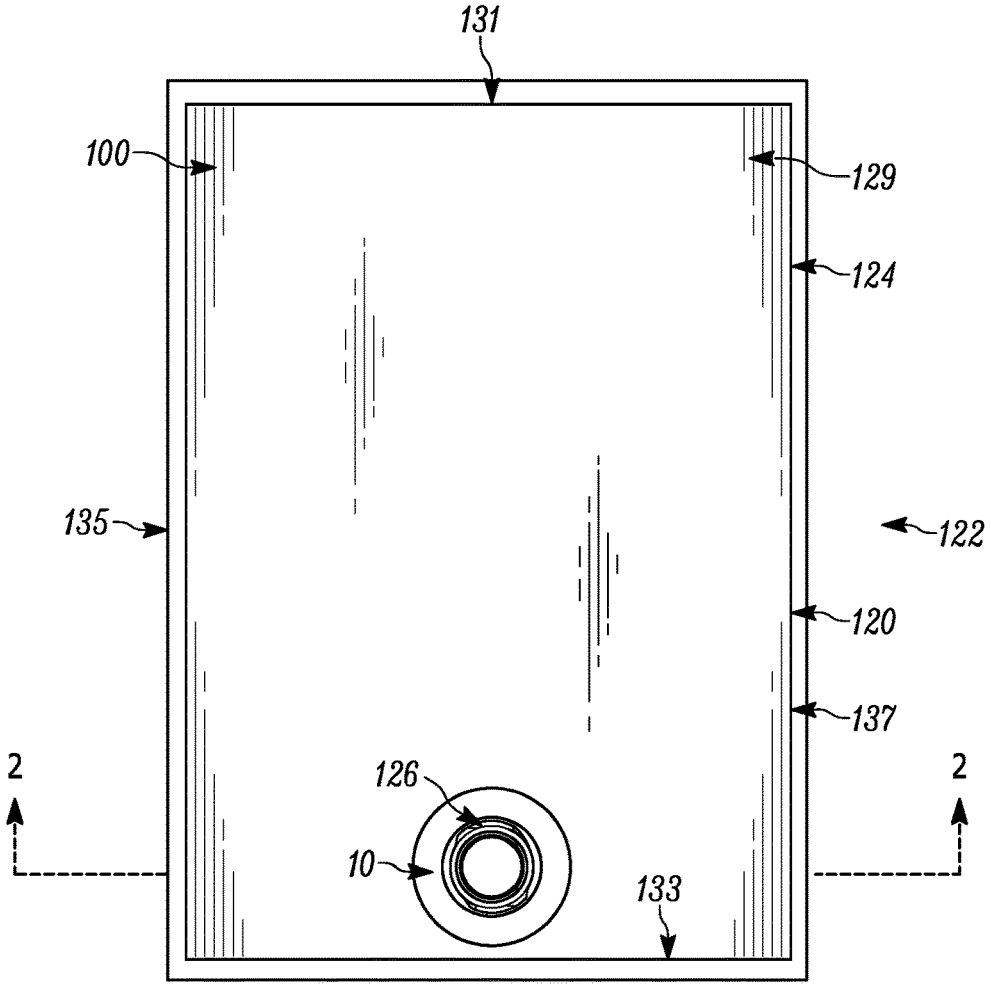
FIG. 1 of the drawings is a top plan view of a flexible bag having the spout of the present disclosure.

While this disclosure is susceptible of embodiment in many different forms, there is shown in the drawings and described herein in detail a specific embodiment(s) with the understanding that the present disclosure is to be considered as an exemplification and is not intended to be limited to the embodiment(s) illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Figure 2:
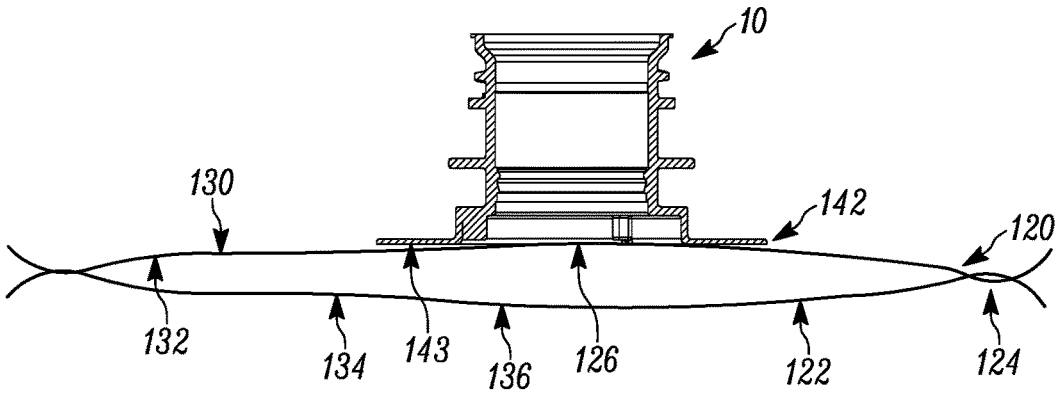
FIG. 2 of the drawings is a cross-sectional view of the flexible bag of the present disclosure, taken generally about lines 2-2 of FIG. 1.
Figure 3:
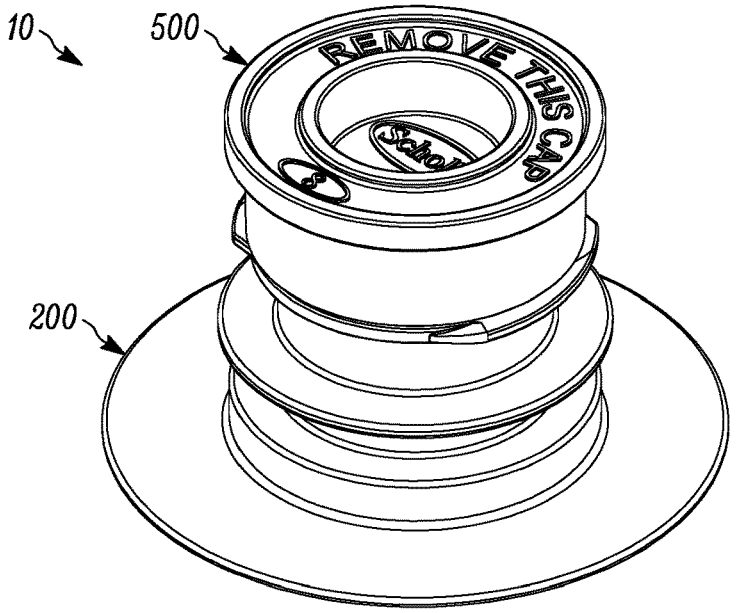
FIG. 3 of the drawings is a perspective view of the spout of the present disclosure.

Referring now to the drawings and in particular to FIGS. 1 and 2, a spout assembly of the present disclosure is shown generally at 10 in an environment coupled to a flexible bag 100. The flexible bag is often placed within a rigid outer container, often termed a bag-in-box package. Such packaging is often utilized for different flowable materials, such as, including, but not limited to, chemicals, detergents, drink syrups, mixes, purees, gels and the like. A dispenser coupling is provided typically which is coupled to the spout for purposes of dispensing the flowable material. The dispenser coupling is physically attached and detached from the spout. The present disclosure is directed to a spout that is configured to accept a coupling with a number of different types of dispenser couplings. In some cases, the dispenser coupling may comprise a screw on configuration, a clasping configuration or a snap configuration.

The flexible bag may comprise any number of different configurations and different materials. For example, and not limited thereto, the flexible bag 100 is shown in FIGS. 1 and 2 as comprising a pillow type bag formed from a single ply or multiple plies of polymer based film (which may be metallized or otherwise treated). Such a bag includes front panel 120 and back panel 122. Front panel 120 includes outer surface 130 and inner surface 132. The back panel 122 includes outer surface 134 and inner surface 136. The front and back panel are positioned in an overlying orientation so that the inner surfaces face each other. It will be understood that while a generally rectangular inner bag is shown, a bag of a different shape, such as a shape that mates with the cavity portion of the outer soft box may be utilized.

The panels are then coupled together by way of seals 124. In the case of a pillow type container, the seals 124 include a top seal 131, bottom seal 133, first side seal 135 and second side seal 137. The seals are generally perpendicular to adjacent seals and parallel to opposing seals to generally define a square or rectangular configuration, thereby defining a generally square or rectangular cavity 129. The seals may be formed through the application of heat, or through other procedures, including, but not limited to RF welding, ultrasonic welding, adhesive, among others. The disclosure is not limited to any particular manner of attachment of the panels.

For many pillow type containers, an opening 126 is provided through the front panel 120 proximate, but spaced apart from the bottom seal 133. A spout 200 can be coupled thereto in sealed engagement. In certain embodiments, multiple spouts may be provided, one, for example, for dispensing, and one for filling. In other embodiments, spouts may be positioned along the seals so as to extend between the panels. The film is configured for use in association with multiple configurations of spouts, as well as in embodiments that do not require spouts.

Spout assembly 10 is shown in FIGS. 3 through 12 as comprising spout 200, insert member 400 and cap 500. The spout 200 is shown in more detail in FIGS. 2 through 9 as comprising base flange 300, cylindrical upstand 302, lower body flange 304, upper body flange 305, upper annular rim flange 306 and dual lead thread 308. The base flange 300 includes lower portion 310 and upper portion 312. The two portions define lower surface 318, top surface 316 and outer surface 314. As will be understood to those of skill in the art, the base flange is coupled to the container body (i.e., typically a conventional pillow-type container) through welding, adhesion or other system typically joining the upper surface to the inside of the panels. The cylindrical upstand 302 extends upwardly from the base flange 300, positioned at a proximal end 324 thereof, and extends generally orthogonal thereto toward distal end 326. Typically, the cylindrical upstand is substantially uniform in cross-section and the inner surface defines a passageway which provides fluid communication with the cavity of the container. A lower spout inward lip 329 is positioned at or near the proximal end of the body 302. As will be explained, the lower spout inward lip 329 is configured to cooperate with the insert member to maintain the insert member in a desired configuration. While termed cylindrical, elliptical as well as other shapes are contemplated.

The lower body flange 304 includes upper surface 330, lower surface 332 and outer surface 334. The lower body flange is spaced apart from the base flange and is generally parallel thereto. Thus, a generally uniform lower channel 370 is defined between the flanges. Filling equipment and dispensing coupling equipment may be configured to grasp the spout 200 about the geometry defined by the defined lower channel and the associated flanges. In the embodiment shown, the upper flange corresponds in diameter to the upper portion 312 of the base flange 300 with the outer surfaces of each being corresponding in configuration (that is, having the same foot print, for example). It will be understood that variations are contemplated.

The upper body flange 305 includes upper surface 336, lower surface 338 and outer surface 339. The upper body flange is spaced apart from the lower body flange and is generally parallel thereto. Thus, a generally uniform central channel 377 is defined between the upper body flange and the lower body flange. In addition, a generally uniform thread channel 379 is defined between the upper body flange and the upper annular rim flange 306. Equipment can utilize either of these channels for purposes of retention structures. The diameter of the upper body flange is less than the lower body flange, and, as will be explained, less than the dual lead helical thread 308.

The upper annular rim flange 306 extends about the distal end of the cylindrical upstand 302. In the embodiment shown, and with respect to FIG. 6, the upper annular rim flange 306 includes inner seat 340 with upstand wall 342 and outer portion 344. The inner seat 340 comprises a portion of enlarged diameter relative to the body 302 and provides a sealing surface that has an arcuate cross-sectional configuration together with the upstand wall 342 that extends upwardly therefrom. The outer portion 344 extends outwardly and provides a lip at the distal end of the upstand wall 342. As will be explained, the diameter of the upper lip is approximately the same as the upper portion of the first and second threadform.

The dual lead thread 308 is disposed between the upper annular rim flange 306 and the upper body flange 305. The dual lead thread 308 is preferably helically wound about the body 302 and includes first threadform 346 and second threadform 348. The first threadform 346 includes upper portion 350 and lower portion 352 which generally lie on the same helical winding (although it will be understood that the two portions may be slightly offset so as to be on slightly different helical windings). Generally, however, the two portions have the same pitch. The upper portion 350 includes first end 353 and second end 354 defining a length thereof. The diameter of the upper portion 350 is smaller than that of the lower portion 352, so that the upper portion diameter is similar to the upper annular rim flange 306, and smaller than the diameter of the upper body flange 305. The upper portion 350 extends approximately one quarter of a turn or revolution.

The lower portion 352 includes first end 355 and second end 356 defining a length. The lower portion is generally three quarters of a turn or so (i.e., 270°) from the upper portion 350, although variations are contemplated where the two structures are, for example, 180° apart from each other. The lower portion 352 extends approximately one third of a turn, although variations are contemplated. The second end 356 of the lower portion 352 generally coincides with the upper body flange 305 and terminates at or near the lower surface 338 of the upper body flange 305. In the embodiment shown, the lower portion 352 extends over the outside of the upper body flange 305. The lower portion 352 includes three regions, a top region 371, a middle region 372 and a bottom region 373. The top region 371 and the bottom region 373 have a slightly reduced pitch, whereas the pitch of the middle region 372 matches that of the upper portion 350. This variation in pitch further provides enhanced retention and resistance to loosening by further altering the load points between the opposing threads.

Similarly, the second threadform 348 includes upper portion 360 and lower portion 362 which generally lie on the same helical winding (although it will be understood that the two portions may be slightly offset so as to be on slightly different helical windings). Generally, however, the two portions have the same pitch. The upper portion 360 includes first end 363 and second end 364 defining a length thereof. The diameter of the upper portion 360 is smaller than that of the lower portion 362, so that the upper portion diameter is similar to the upper annular rim flange, and smaller than the diameter of the upper body flange 305. The upper portion 360 extends approximately one quarter of a turn or revolution The lower portion 362 includes first end 365 and second end 366 defining a length. The lower portion is generally three quarters of a turn or so (i.e., 270°) from the upper portion 360, although variations are contemplated where the two structures are, for example, 180° apart from each other. The lower portion 362 extends approximately one third of a turn, although variations are contemplated. The second end 366 of the lower portion 362 generally coincides with the upper body flange 305 and terminates at or near the lower surface 338 of the upper body flange 305. In the embodiment shown, the lower portion 362 extends over the outside of the upper body flange 305. The lower portion 362 includes three regions, a top region 381, a middle region 382 and a bottom region 383. The top region 381 and the bottom region 383 have a slightly reduced pitch, whereas the pitch of the middle region 382 matches that of the upper portion 360. This variation in pitch further provides enhanced retention and resistance to loosening by further altering the load points between the opposing threads.

The first threadform 346 and the second threadform 348 are positioned so as to be approximately 180° apart from each other (that is, generally corresponding to each other and on opposite sides of each other). The upper portion 350 of the first threadform 346 is shorter than the upper portion 360 of the second threadform 348. Similarly, the lower portion 352 of the first threadform 346 is shorter than the lower portion 362 of the second threadform 348. In other embodiments, the portions of the first threadform may be both longer and/or shorter than the corresponding portions of the second threadform. In still other embodiments, the portions of the first threadform may both be shorter than the corresponding portions of the second threadform. In yet another embodiment, the upper portions may be generally identical, with the lower portions having a longer or shorter relative configuration. In summary the first threadform is of a different length than the second threadform. That is, either or both of the upper portions and the lower portions may be of different lengths. It is possible that while each portion may be of a different length, the combined threadform lengths are the same. Such a configuration results in different lengths of the upper and lower portions, which is defined as being of different length.

Due to the different dispensing couplings in use, the threads are limited in size (i.e., length), as well as thread depth. As such, there is a chance that the connector can be loosened due to vibration or relaxation (i.e., due to creep or deformation). For example, vibrational loads will tend to loosen a fastener over time, and, for the limited thread engagement depth with different dispensing couplings, such loosening is problematic. Through relaxation of the components, pre-load holding force can be reduced. The configuration of the different length of the opposing threadform components positions the loads on the threads on different planes and locations on the opposing threads. Thus, if there is a decrease in the pre-load on one thread due to vibration or relaxation (or other forces or disturbances), while one of the threads may be affected, the other thread may maintain the pre-load holding force. This is because the opposite thread has a different geometry and load points are generally located at different points and different planes. One particular advantage is seen where the starting and ending points of the threads are at different points (that is, the corresponding portions of the threadforms have different lengths, with the possibility of both the first end and the second end not being directly opposing to each other). In the embodiment shown, the lower portions have first ends that are approximately 180° apart, with the second ends that are more than 180° apart. In other embodiments, both the first ends and the second ends of the lower portions of the threadforms may be spaced apart at a distance that are other than 180°. In the embodiment shown, the second end 366 of the lower portion 362 of the second threadform 348 is more than 180° (in a clockwise direction) from the second end 356 of the lower portion 352 of the first threadform 346. Additionally, the differences in pitch along the thread further provide resistance to loosening due to the further altering of the load points between the opposing threads. Additionally, with the variable pitch, and in part due to the different thread pitch of different connectors in the market, advantageously, the connector can engage more easily with the spout, ad interference is minimized during the initial threading sequence. It is predominantly at the last portion or turning of the connector, that the torque on the threads increases with the forces on the point loads of the thread being different between two opposing threads.

It will be understood that in some embodiments, solely a lower portion of each of the first and second threadform may be present, and a flange may extend about the body at a location comparable to that of the upper portions of each of the first and second threadform. In other embodiments, the threadform may be continuous, that is, a single portion that extends about the entirety of the circumference of the body. In still other embodiments, the upper portions of each of the first and second threadform may be of different pitch than the corresponding lower portions.

Figure 5:
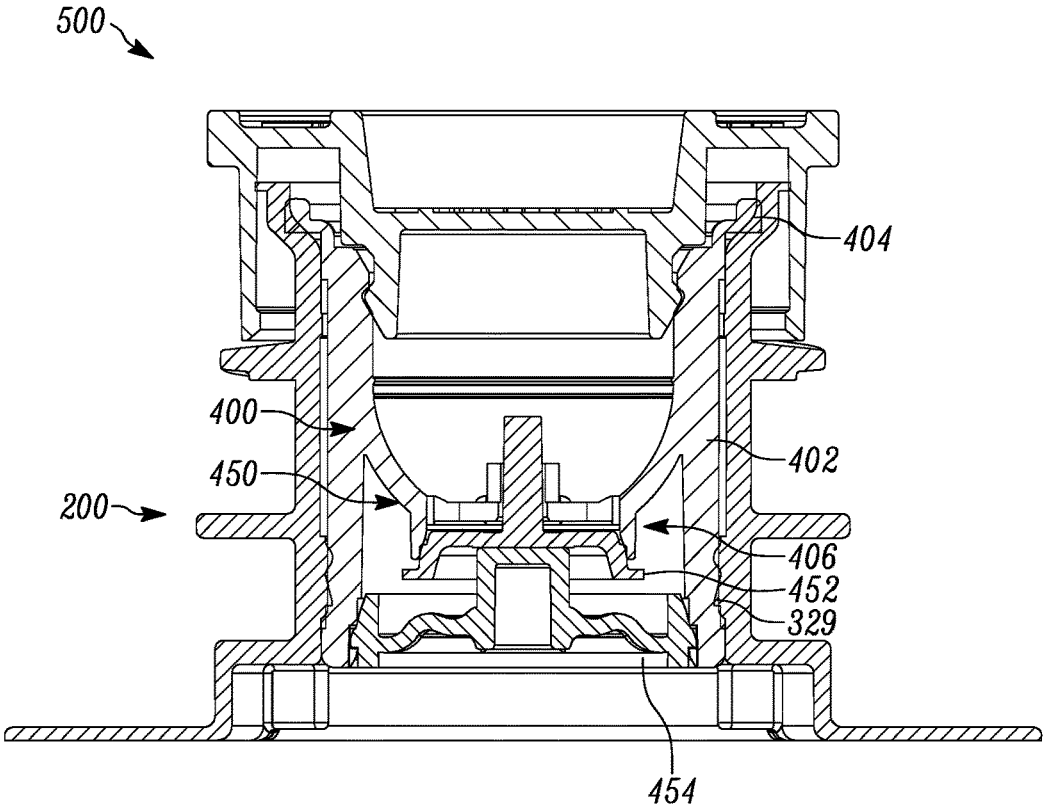
FIG. 5 of the drawings is a cross-sectional view of the spout of the present disclosure.
Figure 6:
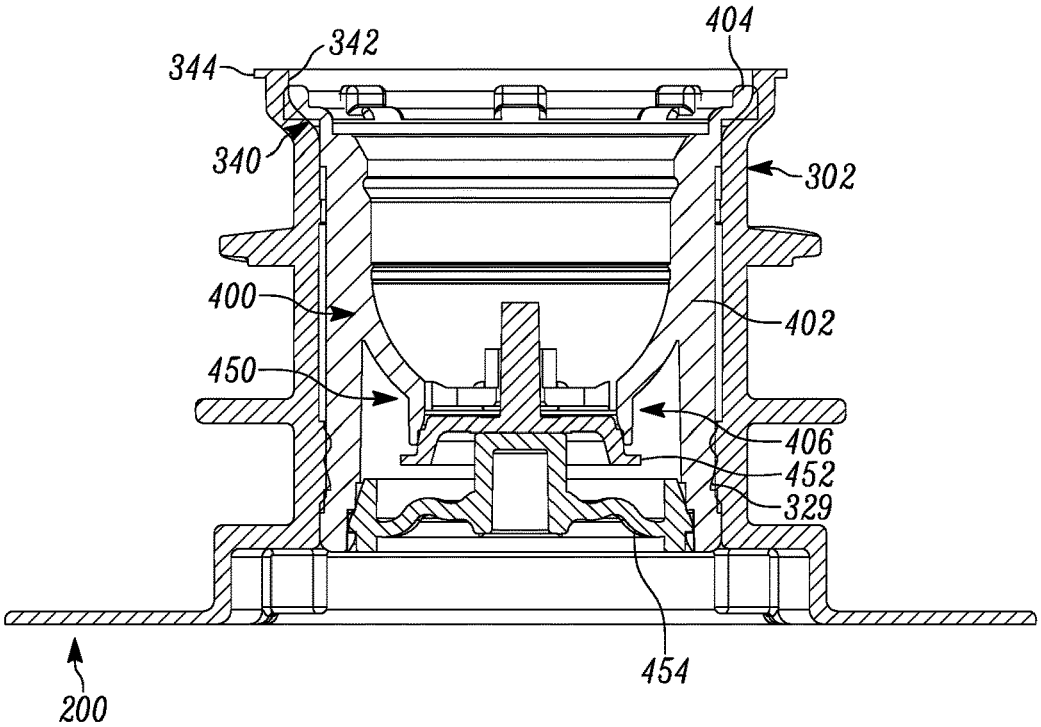
FIG. 6 of the drawings is a cross-sectional view of the spout of the present disclosure, with the cap removed.
Figure 7:
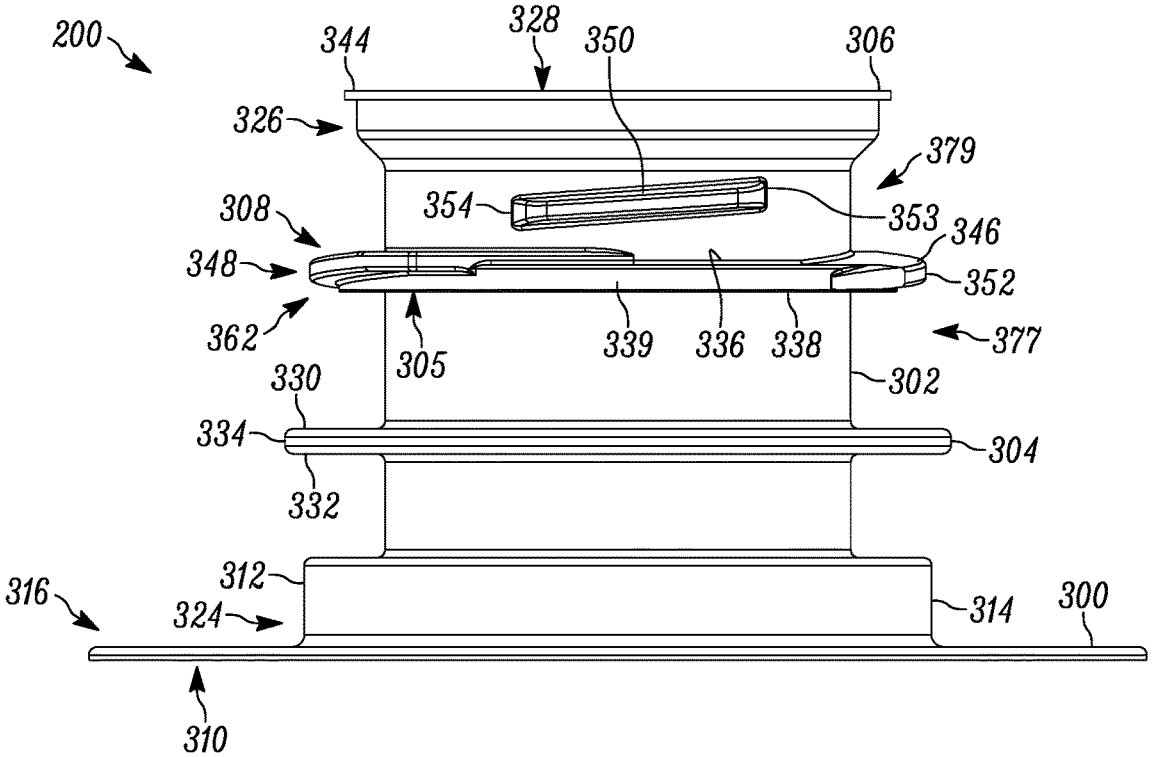
FIG. 7 of the drawings is a first side elevational view of the spout of the present disclosure, with the cap removed.
Figure 8:
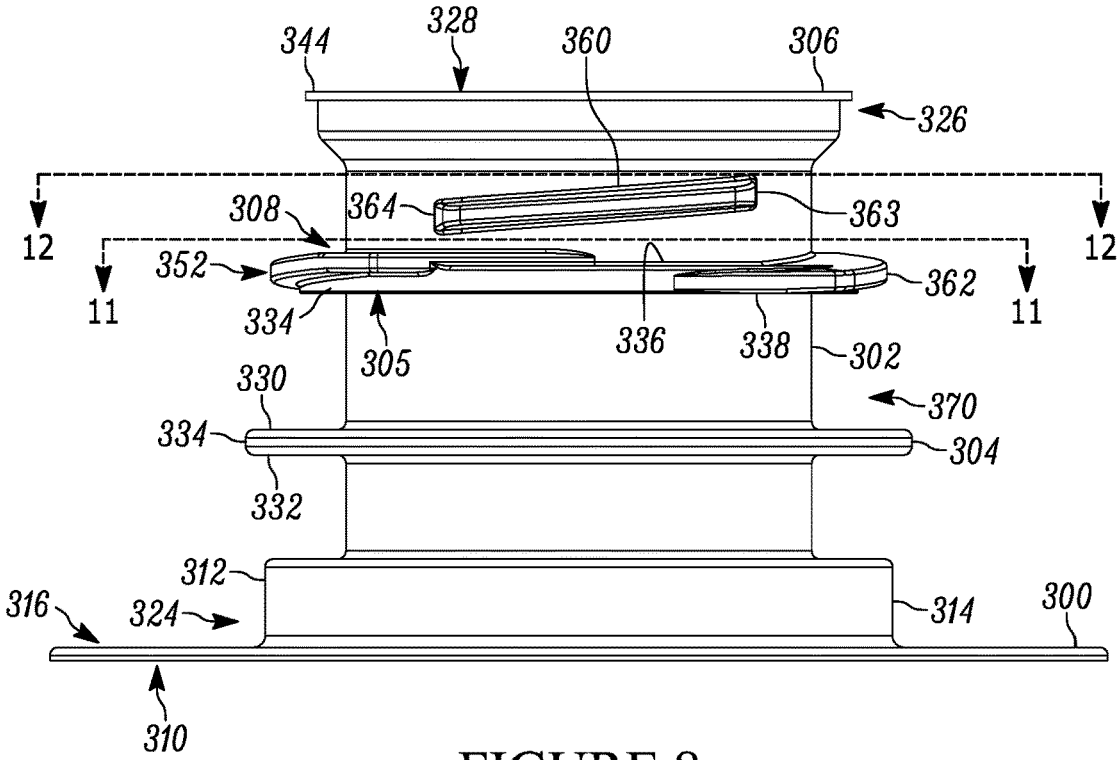
FIG. 8 of the drawings is a second side elevational view of the spout of the present disclosure, with the cap removed.
Figure 9:
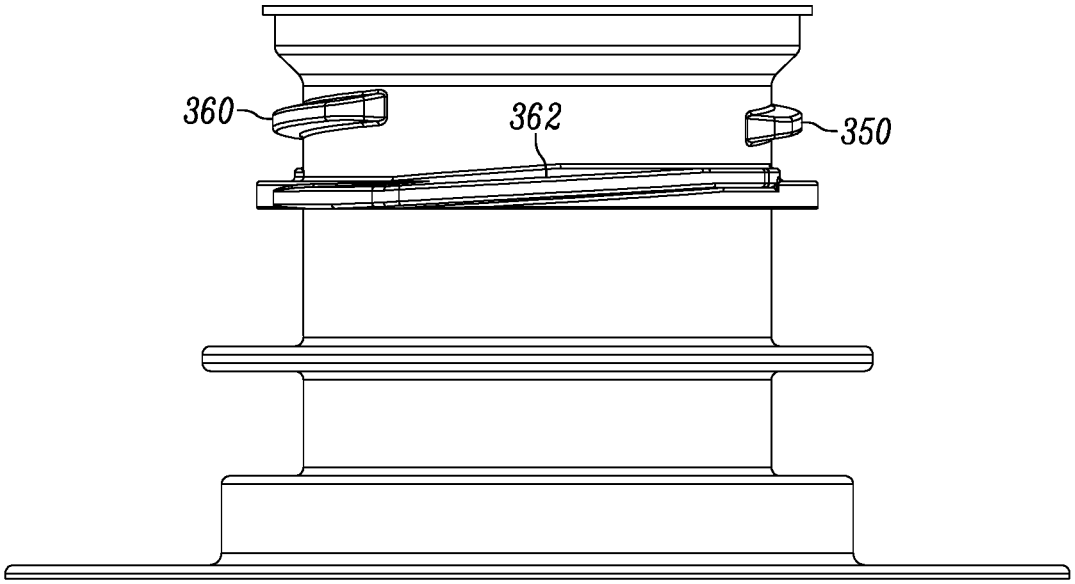
FIG. 9 of the drawings is a front side elevational view of the spout of the present disclosure, with the cap removed.
Figure 10:
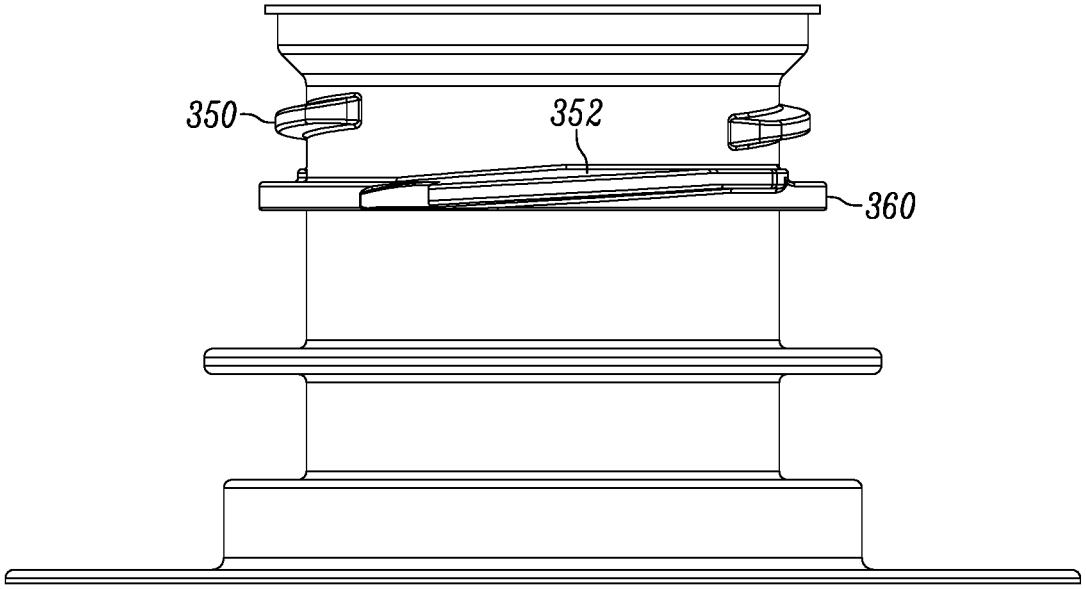
FIG. 10 of the drawings is a back side elevational view of the spout of the present disclosure, with the cap removed.
Figure 11:
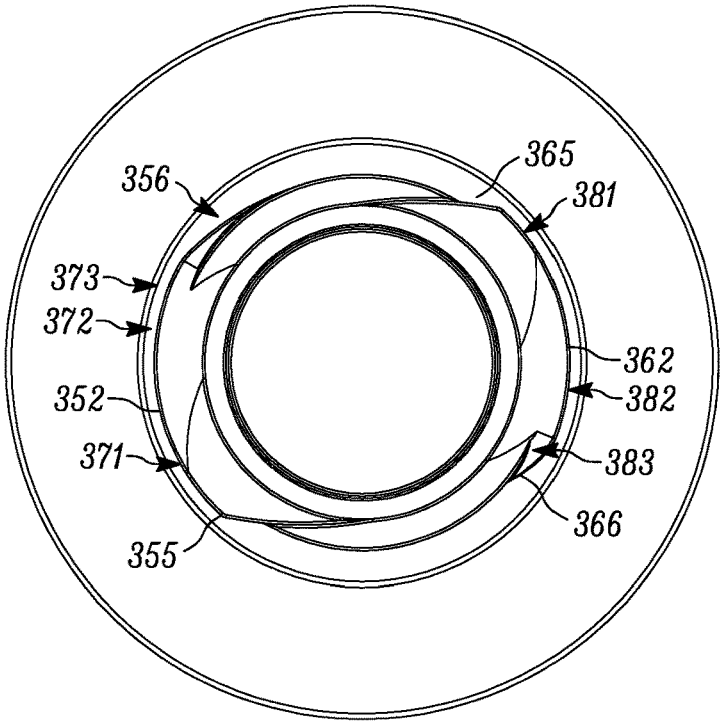
FIG. 11 of the drawings is a cross-sectional view of the spout of the present disclosure, taken generally about lines 11-11 of FIG. 8.
Figure 12:
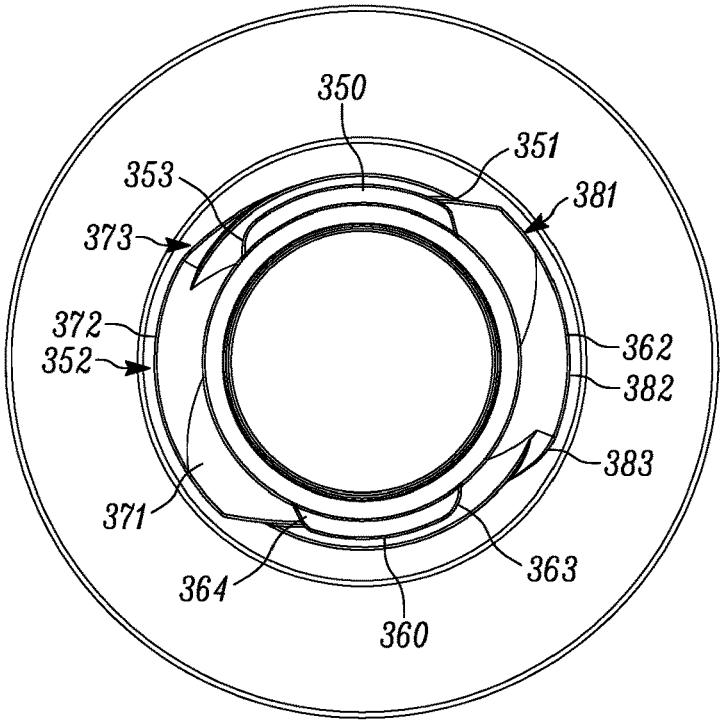
FIG. 12 of the drawings is a cross-sectional view of the spout of the present disclosure, taken generally about lines 12-12 of FIG. 8.
Figure 13:
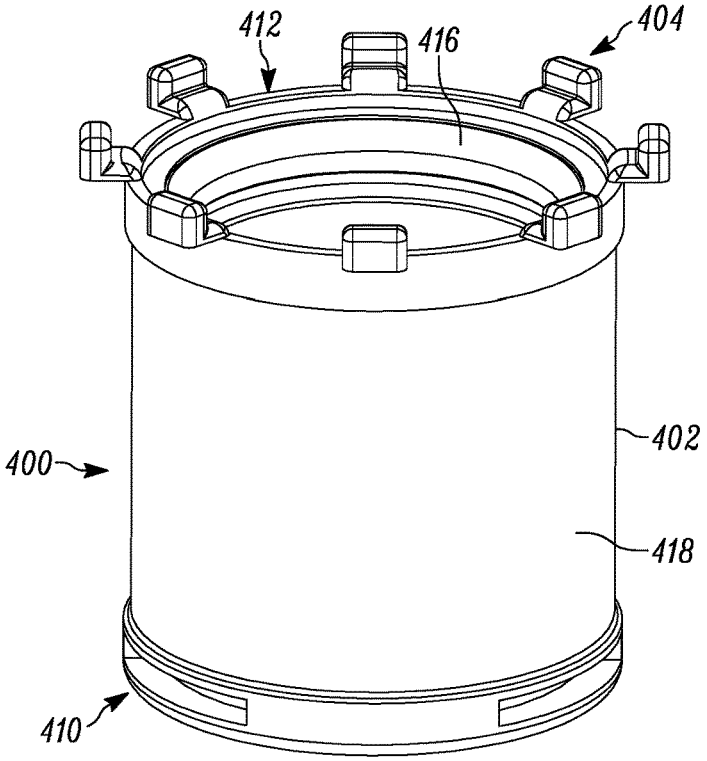
FIG. 13 of the drawings is a perspective view of the insert member of the spout of the present disclosure.

The insert member 400 is shown in FIGS. 5, 6 and 13 as comprising cylindrical body 402, flexible tabs 404 and inner connector valve assembly 406. The cylindrical body extends between bottom end 410 and top end 412. Additionally, the cylindrical body includes inner surface 416 and outer surface 418. As will be explained in more detail below, the cylindrical body is configured to slidably translate within the body 302 such that the outer surface 418 of the insert member, abuttingly engages (and, preferably, sealingly engages) the lower inward lip 329 of the body 302. It will be understood that despite the substantial sealing engagement between the components, slidable movement is provided therebetween, to selectively allow or stop the passage of fluid through the spout 200.

Figure 14:
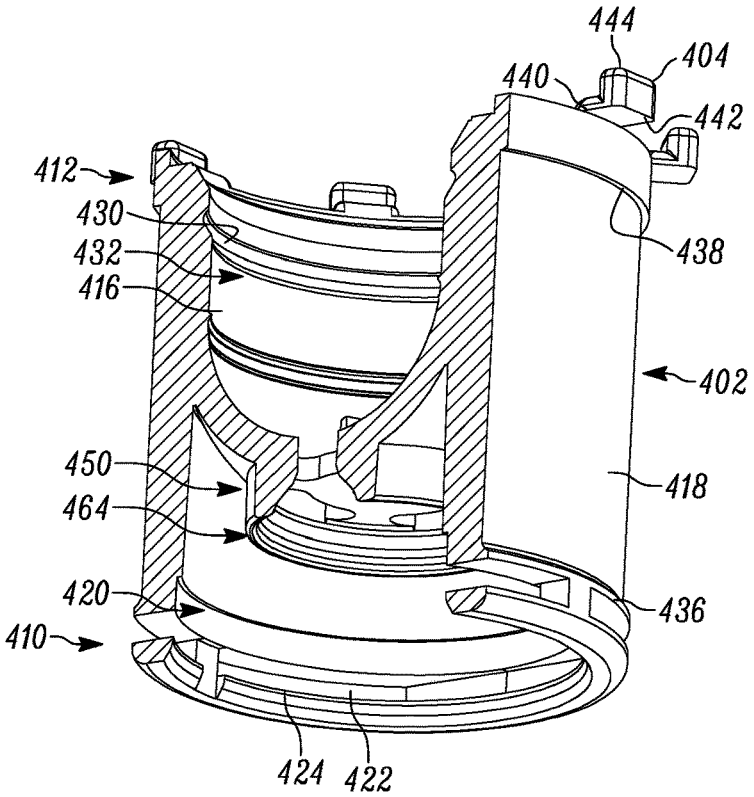
FIG. 14 of the drawings is a perspective cross-sectional view of the cylindrical body and flexible tabs of the insert member of the present disclosure.
Figure 15:
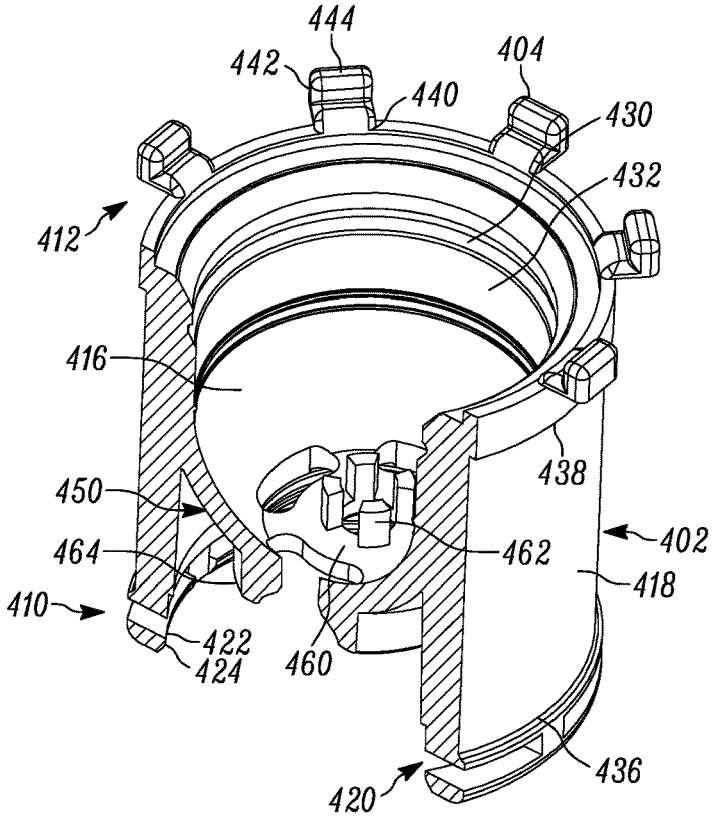
FIG. 15 of the drawings is a perspective cross-sectional view of the cylindrical body and flexible tabs of the insert member of the present disclosure.
Figure 16:
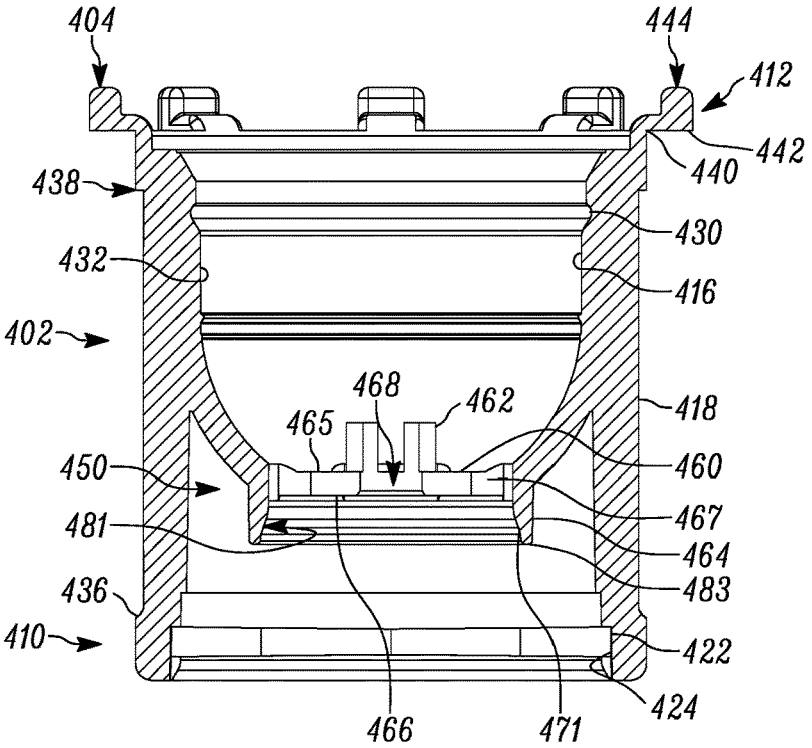
FIG. 16 of the drawings is a cross-sectional view of the cylindrical body of the cylindrical body and flexible tabs of the insert member of the present disclosure.

With reference to FIGS. 14, 15 and 16, the inner surface 416 includes cap engagement undercut 430 and connector seal surface 432. As will be explained, the cap engagement undercut 430 provides for the receipt and retention of a tab on the cap. The connector seal surface provides a relatively smooth and continuous surface for sealing engagement between a connector and the inner surface 416 of the cylindrical body. The inner surface 416 further includes, at a bottom end 410 thereof, a mating structure 420, configured to retain the outer circumferential ring member of the spring member. In the configuration shown, the mating structure includes a recessed circumferential channel 422 forming a lower flange 424. A plurality of openings may extend through the cylindrical body of the insert member within the recessed circumferential channel 422 in a spaced apart configuration, that extend axially outwardly to the outer surface of the insert member. A plurality of step down sections may be presented above the recessed circumferential channel that are configured to accommodate the structure of the outer circumferential ring member.

The outer surface 418 includes lower lip 436 and axial flange 438. The lower lip 436 extends outwardly at or near the bottom end 410 of the cylindrical body 402. The lower lip 436 precludes the insert member from pulling out of the spout in the seated position, as will be described below. The axial flange 438 is positioned at the top end 412 of the insert member, and extends outwardly from the outer surface. The axial flange is configured to interface with a limiting member extending inwardly from the spout so as to limit movement inwardly of the insert member.

Flexible tabs 404 are disposed about the top end 412 of the cylindrical body 402 and, in the resting position extend outwardly from the outer surface 418. In the embodiment shown, a total of eight flexible tabs are disposed generally uniformly about the outer perimeter of the cylindrical body. Each of the flexible tabs is substantially identical (although variations are contemplated), and each include hinge 440, spout surface 442 and inner coupling surface 444. As will be explained the flexible tabs are configured to rotate about hinge 440 wherein the flexible tabs can be urged inwardly by interaction between the spout and spout surface 442, whereupon inward urging directs the inner coupling surface of each of the flexible tabs, and into contact with either a cap or a connector, to provide a clamping force thereagainst.

With reference to FIGS. 5 and 6, inner connector valve assembly 406 is shown as comprising first portion 450, second portion, or poppet 452 and spring member 454. With additional reference to FIGS. 14 through 16, the first portion is integrally formed, in the configuration shown, with the insert member 400, and in particular extends from the connector seal surface 432 (and may form a portion of the connector seal portion, depending on the configuration). The first portion 450 extends generally perpendicular to the direction of travel of the insert member within the spout. The first portion includes base 460, raised encircling portion 462 and lower circumferential depending skirt 464. The base 460 includes upper surface 465, lower surface 466. A plurality of openings, such as openings 467 extend about axially spaced apart from a central bore 468. In the configuration shown, the openings may extend into the connector seal portion as well. In the configuration shown, a total of four elongated openings are axially spaced about the central bore 468, although variations are contemplated.

The raised encircling portion 462 comprises a plurality of upstanding elements that extend upwardly away from the upper surface 465 of the base 460 and encircle the central bore 468. In the configuration shown, a total of four axially spaced tower-like members encircle the central bore, defining a channel therebetween, although variations are contemplated, including variations where the upstanding elements is reduced to zero. In the configuration shown, the raised encircling portion is positioned so that the inner portion thereof corresponds to the central bore. In other configurations, the raised encircling portion comprises a cylindrical member having the central bore therethrough.

The lower circumferential depending skirt 464 comprises a circumferential skirt that extends downwardly from the lower surface 466 of the base 460. The circumferential skirt is continuous and outboard of the openings 467. The lower circumferential depending skirt 464 includes inner surface 481 and terminates at lower edge 483. The inner surface includes seal surface 471 that extends thereabout. The seal surface, as will be explained, interfaces with the poppet 452 to seal the openings and to preclude the passage of fluid therethrough. In the configuration shown, the inner surface 481 extends axially outwardly downstream of the lower surface 466 of the base 460 terminating at the lower edge 483.

Figure 17:
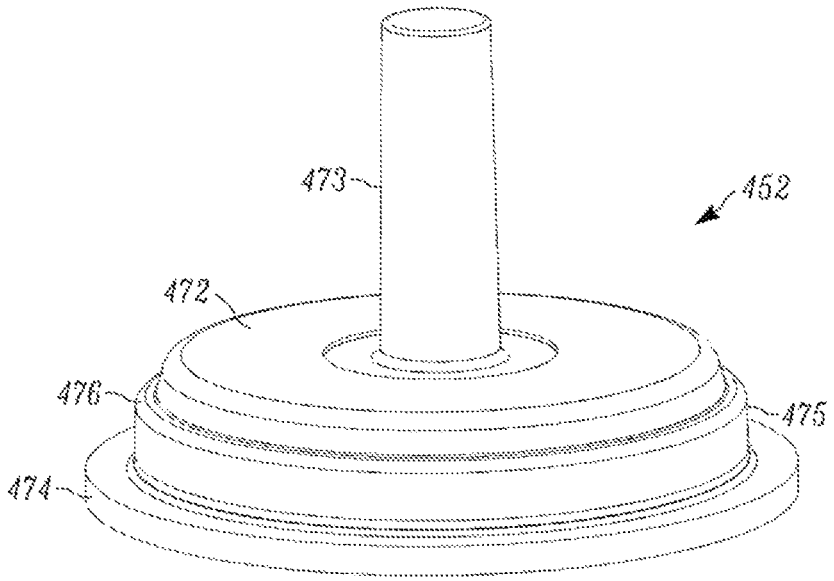
FIG. 17 of the drawings is a perspective view of the poppet of the insert member of the spout of the present disclosure.
Figure 18:
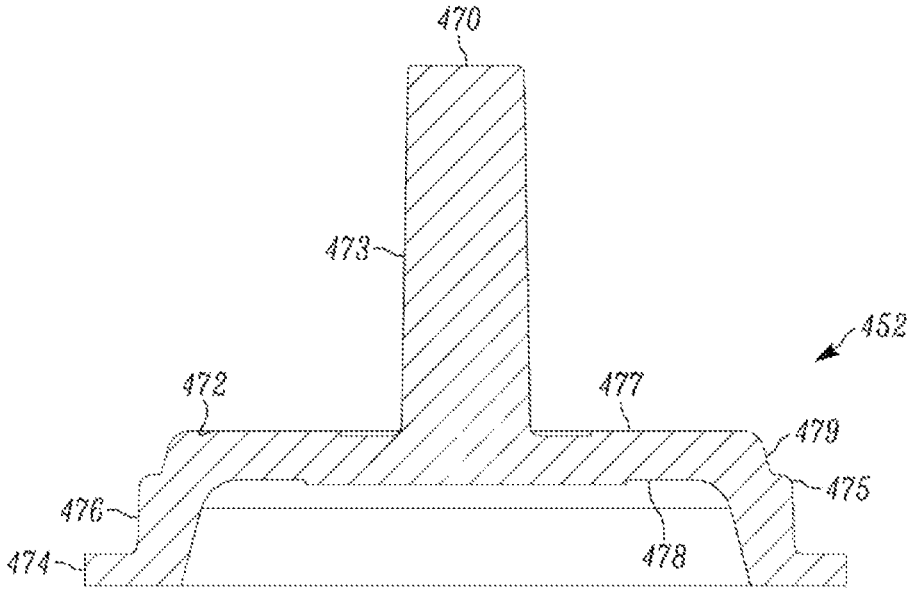
FIG. 18 of the drawings is a cross-sectional view of the poppet of the insert member of the spout of the present disclosure.

With reference to FIGS. 17 and 18, the poppet 452 comprises a resilient member configured to sealingly engage the lower circumferential depending skirt 464. The poppet 452 comprises body 472, central post 473, depending outer rim 476, outer circumferential flange 474 and sealing surface 475. The body 472 includes upper surface 477, lower surface 478 and outer perimeter 479. The central post 473 extends from upper surface 477, and includes top surface 470 at the end thereof. As will be explained below, the central post is sized so as to extend through the central bore 468 and to extend beyond the top surface 470 of the raised encircling portion 462. In the configuration shown, the surfaces of the body and the depending outer rim are continuous and free of openings or the like.

The depending outer rim 476 extends circumferentially about the outer perimeter 479 of the body 472 both downwardly and outwardly (in the configuration shown). The outer circumferential flange 474 extends axially outwardly from a lower end of the depending outer rim 476. The sealing surface 475 comprises a portion of at least one of the depending outer rim 476 and the outer circumferential flange 474 which sealingly engages the seal surface 471 of the lower circumferential depending skirt 46 of the first portion 450. In the configuration shown, the sealing surface comprises a bead that is spaced apart from the body 472 and also from the circumferential flange 474.

Figure 19:
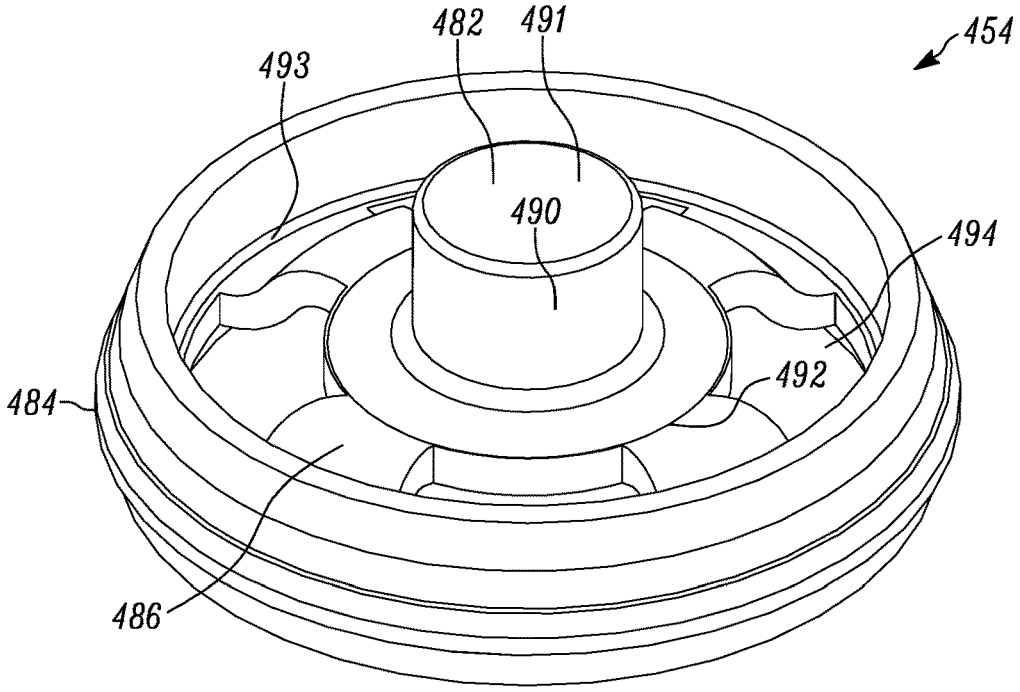
FIG. 19 of the drawings is a perspective view of one embodiment of the spring member of the insert member of the spout of the present disclosure.
Figure 20:
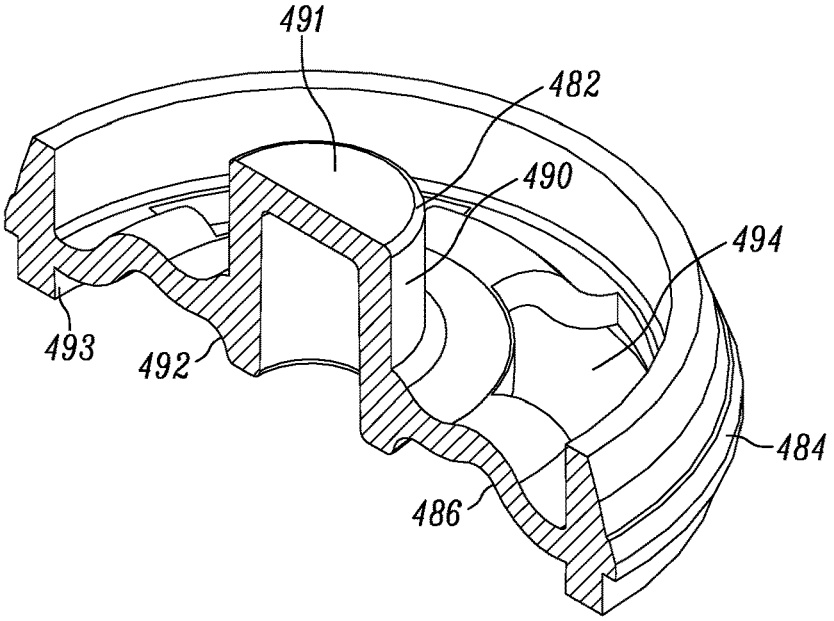
FIG. 20 of the drawings is a perspective cross-sectional view of the embodiment of the spring member of the insert member of the spout of the present disclosure shown in FIG. 19.

With reference to FIGS. 19 and 20, the spring member 454 includes central body member 482, outer circumferential ring member 484 and biasing member 486. The central body member 482 includes outer perimeter 490 and top surface 491. The central body member, and, in particular, the top surface 491 thereof, is configured to interface with the lower surface 478 of the poppet body 472. In the configuration shown, the spring member is a separate structure from the second portion. In the configuration shown, as well, the spring member comprises a molded polymer member, as does the second portion.

The outer circumferential ring member 484 extends circumferentially about the central body member 482 and is configured to, as will be explained, engage the inner surface of the insert member 400 in sealed engagement. The biasing member 486 extends between the central body member 482 and the outer circumferential ring 484 and includes an inner end 492 and an outer end 493. A plurality of openings 49 extend through the biasing member, and are configured to allow the passage of fluid therethrough.

Figure 21:
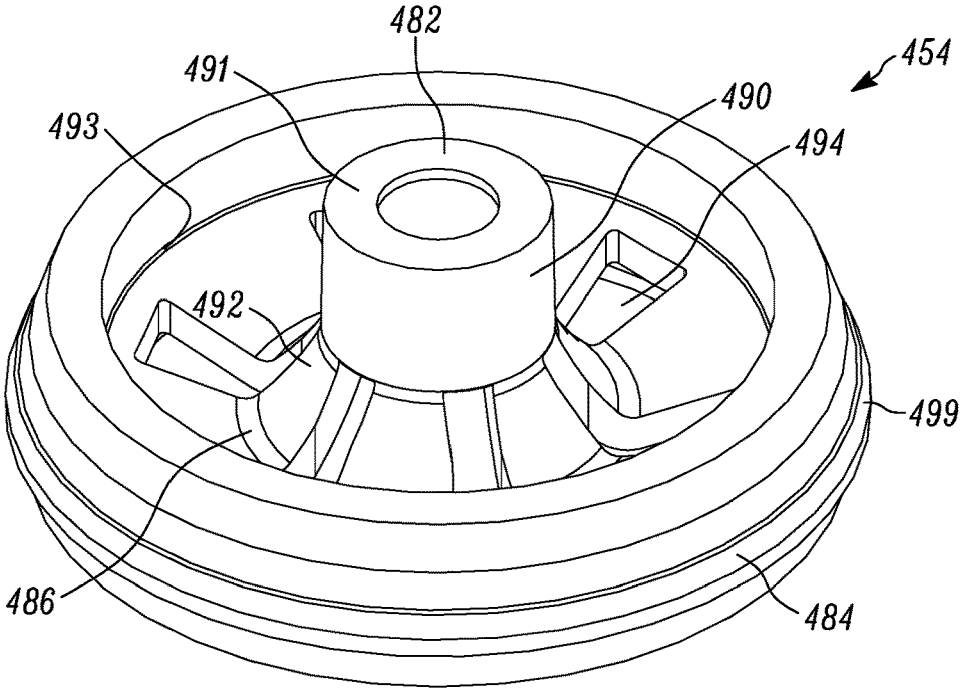
FIG. 21 of the drawings is a perspective view of a second embodiment of the spring member of the insert member of the spout of the present disclosure.
Figure 22:
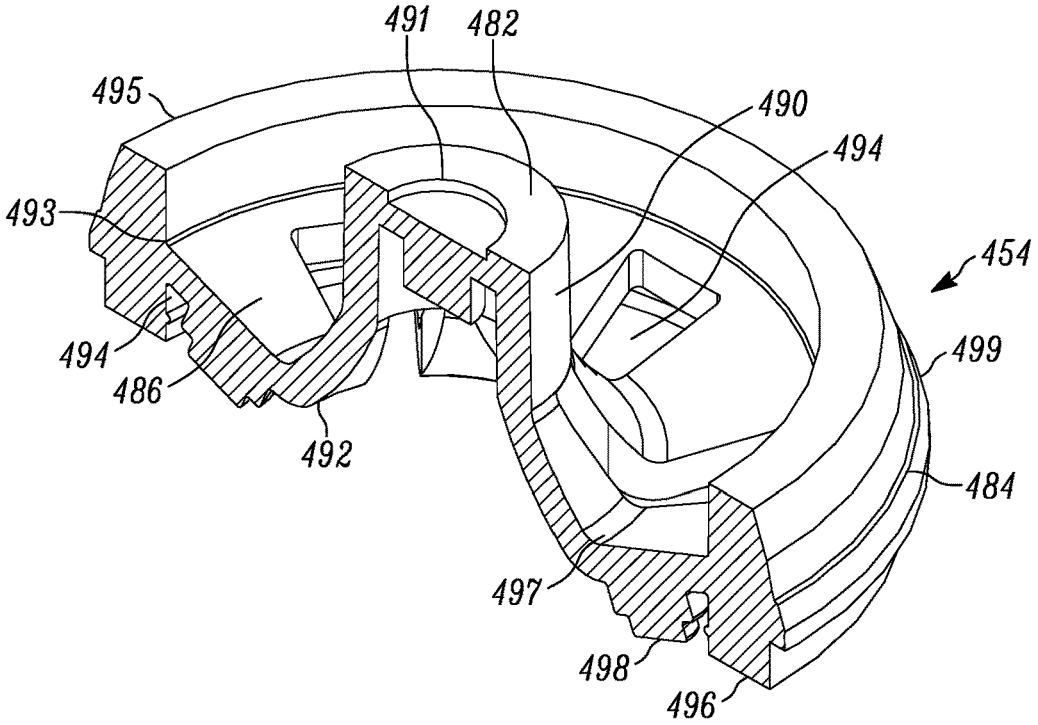
FIG. 22 of the drawings is a perspective cross-sectional view of the second embodiment of the spring member of the insert member of the spout of the present disclosure shown in FIG. 21.

A second embodiment of the spring member 454 is disclosed in FIGS. 21 and 22. The second embodiment of the spring member includes similar structures as the first embodiment, and such structures are identified with the same reference number. In such a second configuration, the central body member 482 further has the outer perimeter 490 defining an outer surface with a lower annular end 485. Additionally, the outer circumferential ring member 484 includes top edge 495, bottom edge 496 and circumferential stop bead 494. The outer end 493 of the biasing member 486 meets the outer circumferential ring member 484 between the top edge 495 and the bottom edge 496, with the circumferential stop bead 494 extending about the inner surface between the outer end 493 of the biasing member and the bottom edge 496. The central body member extends upwardly beyond the top edge of the outer circumferential ring member.

The outer circumferential ring further includes outer locking flange 499 that extends about the outer circumference of the ring member between the top and bottom edges. As will be understood, the locking flange interfaces and engages with the insert member so as to be fixedly engaged therewith.

The biasing member 486 further includes an annular inflection ring 497 between the inner and outer ends thereof. In the configuration shown, the biasing member includes a first portion that extends downstream from the lower annular end 485 to the annular inflection ring 497. At such time, the biasing member returns gently in an upstream direction to the outer end 493 thereof. As such, the biasing member comprises a concave hoop-like configuration between the central body member and the outer circumferential ring member that is concave in an upward direction and convex in the downward direction.

An annular stop member 498 (which in the configuration shown comprises a plurality of nodes spaced about the biasing member between the annular inflection ring 497 and the outer end 493 and protruding from a lower surface of the biasing member 486) controllably interfaces with the circumferential stop bead and limits further pivoting of the biasing member, generally between the annular inflection ring 497 and the outer end. It will be understood that further downward movement of the central body member is compensated for by movement or deflection of the biasing member between the inner end 492 and the annular inflection ring. By varying the relative upstream and downstream slopes, the effective operating parameters of each can be controlled and varied. In the configuration shown, pivoting of the portion between the annular inflection ring and the outer end requires less force than pivoting of the portion between the inner end and the annular inflection ring.

Figure 4:
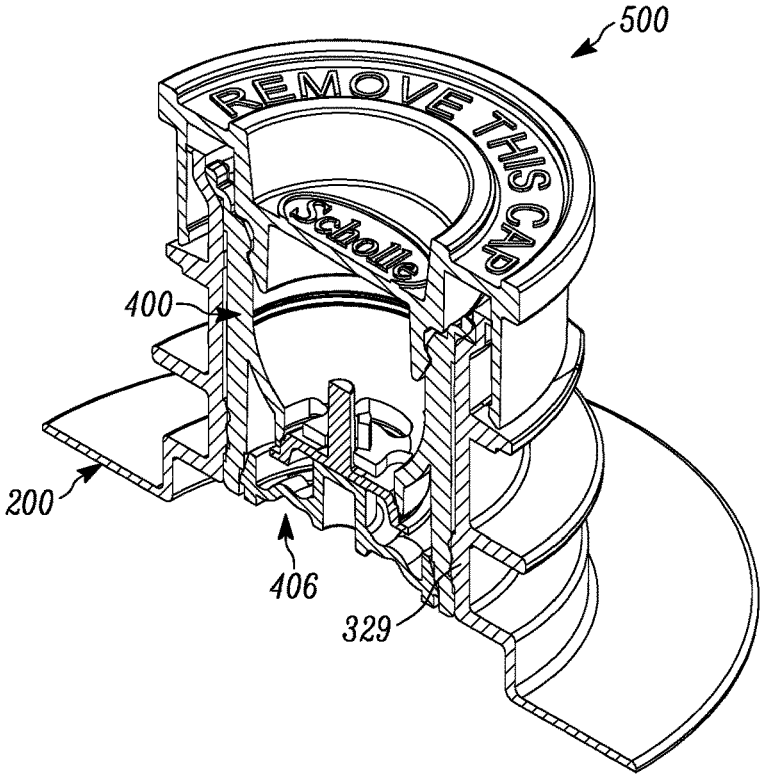
FIG. 4 of the drawings is a perspective cross-sectional view of the spout of the present disclosure.

The cap 500 is disclosed in FIG. 4 as being positionable over the device. It will be understood that the cap 500 can be positioned in a first dust cover position, wherein the insert member is only partially seated. Similarly, the cap 500 can be positioned in a second seated position wherein the insert member is fully inserted and seated within the spout.

To assemble the insert member and associated components, the poppet 452 is directed into the insert member 400 so that the central post 473 extends through the central bore 468. Further insertion eventually engages the sealing surface 475 of the poppet with the seal surface 471 of the lower circumferential depending skirt 464. In particular, the two structures engage prior to the body of the poppet reaching the lower surface of the base, in the configuration shown. Additionally, with the seal surface 471 applies an inward force to counter the outward force of the sealing surface 475 thereagainst.

Next, the spring member 454 is coupled to the insert member 400. In particular, the outer circumferential ring member 484, and, in particular, the outer locking flange 499 thereof, is directed into the mating structure 420 on the inner surface 416 the insert member. The spring is fixedly coupled, in the configuration shown, to the recessed circumferential channel 422, and precluded from movement, in part due to the lower flange 424. The outer locking flange 499 may include an inclined region in the upstream direction which lowers the force necessary to direct the outer locking flange 499 into the mating structure 420. It will be understood that the upper portion of the spring outer circumferential ring 484 interferes with the upper flange of the insert mating structure 420 and the channel defined thereby, creating a substantially fluid-tight, and preferably fully fluid-tight, seal therebetween.

At the same time, the central body member 482 interfaces with the lower surface 478 of the body of 472 of the poppet, pushing the poppet upwardly and pressing the sealing surface 475, preferably both outwardly and upwardly, into the seal surface 471 to sealingly engage the same (placing the second portion in the sealed configuration). The biasing member maintains a force upwardly to maintain the sealed engagement. In the configuration shown, the upper surface 477 of the body of the poppet 452 remains spaced apart from the lower surface 466 of the base 460 of the first portion. Additionally, the lower edge 483 of the lower circumferential depending skirt 464 remains spaced apart from the outer circumferential flange 474. And, the diameter of the outer circumferential flange is less than the diameter of the inner end of the outer circumferential ring member, but greater than that of the lower circumferential depending skirt.

Figure 23:
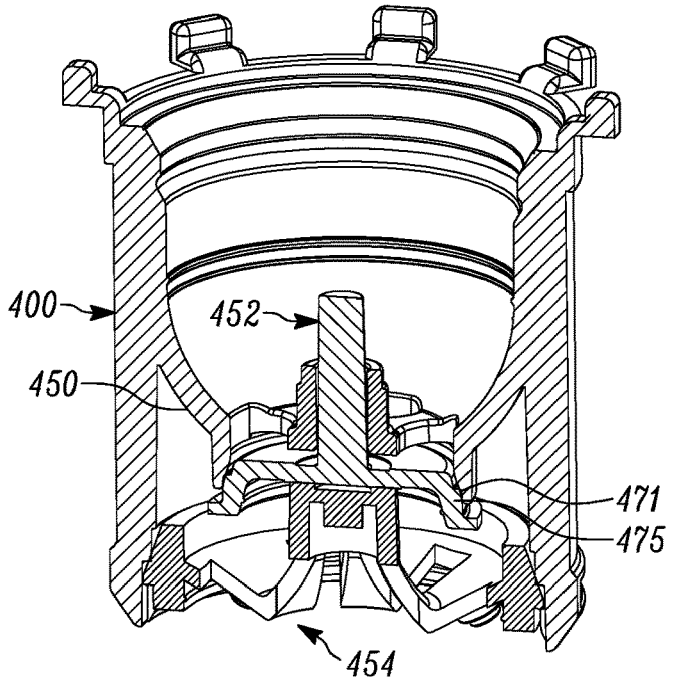
FIG. 23 of the drawings is a cross-sectional view of the second embodiment of the spring member in the overall spout assembly.
Figure 24:
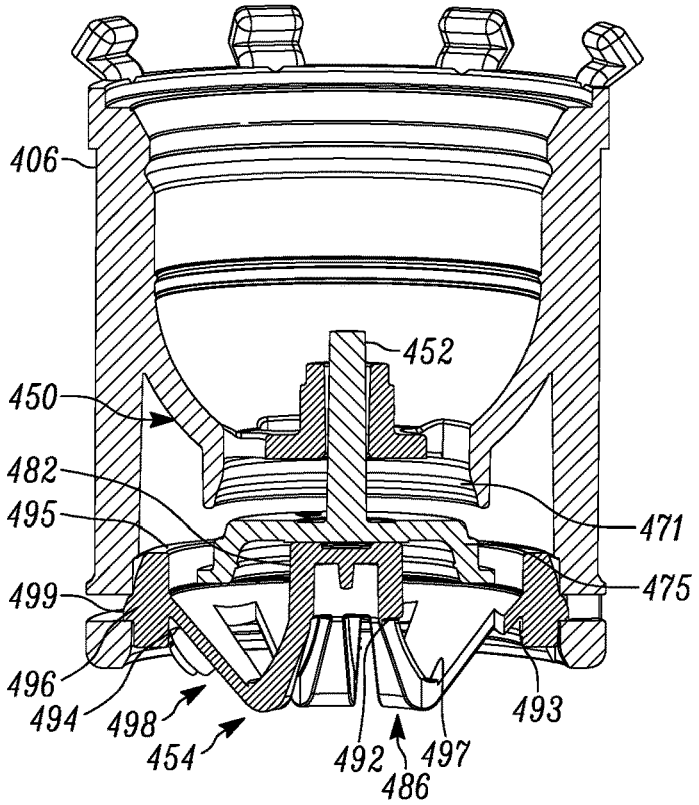
FIG. 24 of the drawings is a cross-sectional view of the second embodiment of the spring member showing an open configuration of the second portion.

In operation, when the connector structure is introduced into the insert member, depending on the configuration of the connector, the connector structure may direct the insert member relative to the outer spout, at which time the flexible tabs rotate inwardly to capture the connector structure. With reference to FIGS. 23 and 24, along with FIGS. 16, 18, 20 and 21, further movement of the connector structure will direct the connector structure into contact with the central post 473 and direct the central post in a downstream position. Continued force against the central post will overcome the biasing member 486 and allow the poppet to be moved away from the first portion of the valve assembly.

Such movement eventually disengages the sealing surface 475 from the seal surface 471 thereby allowing the passage of fluid through the valve and into the connector, to dispense from the bag. Thus, the second portion is directed from the sealed configuration to the open configuration, wherein the sealing surface and the seal surface are separated and fluid can be directed thereacross.

In the configuration of the biasing member of FIGS. 20 and 21, with further reference to FIGS. 23 and 24, initial movement preferentially directs the portion of the biasing member between the annular inflection ring 497 and the outer end 493 to deflect. Eventually, the annular stop member 498 reaches the circumferential stop bead 494 and further deflection/pivoting is substantially precluded. If further force is applied, then the portion of the biasing member between the annular inflection ring 497 and the inner end 492 begins to deflect to a greater extent. Of course, variations are contemplated, and in some instances, both of the portions of the biasing member on either side of the annular inflection ring will deflect, pivot and otherwise distort.

When the connector is removed, the biasing member will redirect the poppet into sealed engagement with the first portion. That is, the biasing member will direct the poppet in the upward direction until the sealing surface 475 engages with the seal surface 471 of the lower circumferential depending skirt 464. Where the insert member has moved relative to the spout, further removal of the connector will return the insert member to its initial position and the flexible tabs will release their retention of the connector.

The foregoing description merely explains and illustrates the disclosure and the disclosure is not limited thereto except insofar as the appended claims are so limited, as those skilled in the art who have the disclosure before them will be able to make modifications without departing from the scope of the disclosure.

What is claimed is:

1. A fitment comprising:

a spout member having a base flange and a cylindrical upstand extending from the base flange, the base flange structurally configured to sealingly engage about an opening of a bag, the cylindrical upstand terminating at a distal end;

an insert member slidably positionable within the spout member, the insert member having a bottom end and a top end, the top end terminating in a plurality of flexible tabs, and with the top end being slidably positionable within the cylindrical upstand of the spout member, the insert member having a valve assembly, the valve assembly including:

a first portion fixedly coupled to the insert member, the first portion having a base with an upper surface and a lower surface, a central bore extending therethrough and at least one opening extending therethrough, and, a lower circumferential depending skirt extending away from the lower surface of the base and encircling the at least one opening and central bore, the lower circumferential depending skirt having an inner surface and terminating at a lower edge, a seal surface positioned on the inner surface of the lower circumferential depending skirt;

a second portion slidably movable relative to the first portion, the second portion including a body with a central post extending upwardly from the body and into the central bore, with a depending outer rim extending about the body and including a sealing surface disposed thereon, the second portion slidably positionable between a sealing configuration wherein the seal surface of the first portion sealingly engages with the sealing surface of the second portion, to preclude the passage of fluid across the second portion and through the at least one opening of the first portion and an open configuration wherein the sealing surface is spaced apart from the seal surface; and a spring member having a central body member, an outer circumferential ring member and a biasing member extending therebetween, the outer circumferential ring member fixedly coupled to the insert member with the central body radially inwardly spaced therefrom, the central body having a top surface engageable with the second portion, and the biasing member including at least one opening, the biasing member biasing the second portion into the sealing configuration, whereupon overcoming the biasing member places the second portion into the open configuration;

wherein the outer circumferential ring member of the spring member includes an outer locking flange structurally configured to fixedly engage a recessed circumferential channel in the insert member; and wherein the recessed circumferential channel in the insert member includes a plurality of axial openings extending therethrough to an outer surface of the insert member.

2. The fitment of claim 1 wherein the at least one opening of the first portion is axially spaced apart from the central bore, with a raised encircling portion extending upwardly away from the upper surface of the base of the first portion about the central bore.

3. The fitment of claim 2 wherein the at least one opening comprises a plurality of openings axially spaced outwardly from the central bore and between the central bore and the lower circumferential depending skirt.

4. The fitment of claim 1 wherein the body of the second portion includes an upper surface, wherein the upper surface of the body is spaced apart from the lower surface of the base of the first portion when the second portion is in the sealing configuration.

5. The fitment of claim 4 wherein the sealing surface of the depending outer rim is spaced apart from the upper surface of the body.

6. The fitment of claim 5 wherein the seal surface of the lower circumferential depending skirt is spaced apart from the lower edge thereof.

7. The fitment of claim 6 wherein the second portion further includes an outer circumferential flange that is positioned at an end of the depending outer rim, opposite the body, the outer circumferential flange extending axially outwardly from the depending outer rim.

8. The fitment of claim 7 wherein the outer circumferential flange extends axially outwardly beyond the lower circumferential depending skirt of the second portion.

9. The fitment of claim 8 wherein in the sealed configuration the outer circumferential flange remains spaced apart from the lower edge of the lower circumferential depending skirt.

10. The fitment of claim 1 wherein the insert member is slidably movable relative to the spout member.

11. The fitment of claim 1 wherein the outer circumferential ring member further includes a top edge and a bottom edge, with the biasing member coupled to the outer circumferential ring spaced apart from each of the top edge and the bottom edge.

12. The fitment of claim 1 wherein the first portion is integrally formed with the insert member, and wherein the second portion and the spring member comprise separate components.

13. The fitment of claim 1 wherein the spout member further comprises:

a dual lead thread extending along an outer surface of the cylindrical upstand between a proximal end and the distal ends thereof, the dual lead thread having a first threadform and a second threadform, the first threadform having a first threadform length and the second threadform having a second threadform length, with the length of the first threadform being different than that of the second threadform, wherein, the first threadform includes an upper portion and a lower portion and the second threadform includes an upper portion and a lower portion, each upper portion and each lower portion having a length, wherein the length of the upper portion of the first threadform is different than the length of the upper portion of the second threadform, and wherein the length of the lower portion of the first threadform is different than the length of the lower portion of the second threadform, and wherein the lower portion of the first threadform is spaced about 180° from the lower portion of the second threadform, with the upper portion of the first threadform being spaced about 270° from the lower portion of the first threadform, and the upper portion of the second threadform being spaced about 270° from the lower portion of the second threadform, with the upper portion of the first threadform being spaced about 180° from the upper portion of the second threadform.

14. The fitment of claim 13 wherein the first threadform and the second threadform terminate at an upper body flange that is spaced apart from the proximal and distal end of a body of the spout.

15. The fitment of claim 13 wherein the lower portion of the first and second threadform each define a thickness, with the thickness being substantially uniform.

16. A fitment comprising:

a spout member having a base flange and a cylindrical upstand extending from the base flange, the base flange structurally configured to sealingly engage about an opening of a bag, the cylindrical upstand terminating at a distal end;

an insert member slidably positionable within the spout member, the insert member having a bottom end and a top end, the top end terminating in a plurality of flexible tabs, and with the top end being slidably positionable within the cylindrical upstand of the spout member, the insert member having a valve assembly, the valve assembly including:

a first portion fixedly coupled to the insert member, the first portion having a base with an upper surface and a lower surface, a central bore extending therethrough and at least one opening extending therethrough, and, a lower circumferential depending skirt extending away from the lower surface of the base and encircling the at least one opening and central bore, the lower circumferential depending skirt having an inner surface and terminating at a lower edge, a seal surface positioned on the inner surface of the lower circumferential depending skirt;

a second portion slidably movable relative to the first portion, the second portion including a body with a central post extending upwardly from the body and into the central bore, with a depending outer rim extending about the body and including a sealing surface disposed thereon, the second portion slidably positionable between a sealing configuration wherein the seal surface of the first portion sealingly engages with the sealing surface of the second portion, to preclude the passage of fluid across the second portion and through the at least one opening of the first portion and an open configuration wherein the sealing surface is spaced apart from the seal surface; and a spring member having a central body member, an outer circumferential ring member and a biasing member extending therebetween, the outer circumferential ring member fixedly coupled to the insert member with the central body radially inwardly spaced therefrom, the central body having a top surface engageable with the second portion, and the biasing member including at least one opening, the biasing member biasing the second portion into a sealing configuration, whereupon overcoming the biasing member places the second portion into an open configuration, wherein the biasing member defines a hoop-like member that is concave in an upward direction toward the second portion;

wherein the biasing member includes an annular inflection ring spaced apart from an inner end and an outer end thereof, with an inner portion between the inner end and the annular inflection ring extending in a direction away from the second portion to the annular inflection ring, and with an outer portion between the outer end and the annular inflection ring extending in a direction toward the first portion and away from the annular inflection ring; and wherein the outer portion of the biasing member further includes an annular stop member protruding from a lower surface of the outer portion and spaced apart from the annular inflection ring and from the outer circumferential ring, with the annular stop member configured to interface with the outer circumferential ring member spaced apart from the biasing member toward the bottom edge of the outer circumferential ring to preclude further relative movement therebetween in a first direction.

* * * * *